United States Patent [19]

Matthews

[11] Patent Number: 4,808,120

[45] Date of Patent: Feb. 28, 1989

[54] ELECTRIC CONNECTORS

[75] Inventor: Maurice A. Matthews, Basingstoke, United Kingdom

[73] Assignee: Electronic Components Limited, Mid-Glamorgan, Wales

[21] Appl. No.: 174,693

[22] Filed: Mar. 29, 1988

Related U.S. Application Data

[63] Continuation-in-part of Ser. No. 936,060, Nov. 28, 1986, abandoned.

[51] Int. Cl.[4] ..... H01R 13/627

[52] U.S. Cl. ..... 439/357; 439/557

[58] Field of Search ..... 439/284, 293, 350, 355, 439/357, 660, 692, 699, 557

[56] References Cited

U.S. PATENT DOCUMENTS 4,108,522 8/1978 Favale ..... 439/357

FOREIGN PATENT DOCUMENTS 819115 10/1951 Fed. Rep. of Germany ..... 439/350

OTHER PUBLICATIONS

Uberbacher et al., "Protector for Leaf Type Contacts", IBM Tech. Discl. Bull., vol. 3, No. 6, p. 10, 11-1960.

*Primary Examiner*—Eugene F. Desmond
*Assistant Examiner*—Stephen Zagrobelny
*Attorney, Agent, or Firm*—Thomas E. Sisson

[57] ABSTRACT

A connector having two mutually engagable parts wherein a first part comprises a molded plastic housing having a pair of springy toothed prongs or clips between which a male contact extends and is supported against a finger of the body of the housing which projects between the clips. The other part comprises an elongate molded plastic housing having channel section which is arranged to hold a female contact between external walls. Notches complementary with toothed parts of the clips are provided such that the two parts of the connector mutually engage in interlocking relationship when mated. The finger serves as a closure for the channel section when the parts are mated.

2 Claims, 2 Drawing Sheets

ELECTRIC CONNECTORS

BACKGROUND AND SUMMARY OF THE INVENTION

This application is a continuation-in-part application of copending application Ser. No. 936,060, filed Nov. 28, 1986, now abandoned.

The present invention relates to electrical connectors.

According to the present invention there is provided an electrical connector including a male part which comprises an elongate male contact member having intermediate its length a collar, an open plastics housing having side walls, a central apertured cross member and a flexible bridge which extends between the walls, the bridge being separated from the cross member by the length of the collar. The contact member is arranged such that leading end of the contact member passes through the aperture in the cross member. The collar is held between the bridge and the cross member. The male part further has clips respectively formed integrally with the walls at a forward extremity thereof.

A female part of the connector comprises an elongate female contact member having intermediate its length a square collar with a circular collar adjacent thereto, an open plastics housing having side walls providing a central channel narrowed at one end, an aperture formed in the base of the channel, and external indentations in the walls adjacent the narrowed part of the channel for receiving the clips of the male part. The female contact member fits into the channel with its square collar located by the aperture in the base of the channel and held in position by the circular collar fitting snugly into the narrowed part of the channel.

BRIEF DESCRIPTION OF THE DRAWING

A connector in accordance with the invention will now be described by way of example only with reference to the accompanying drawings of which.

DETAILED DESCRIPTION OF THE PREFERRED EMBODIMENT

Figure 1:
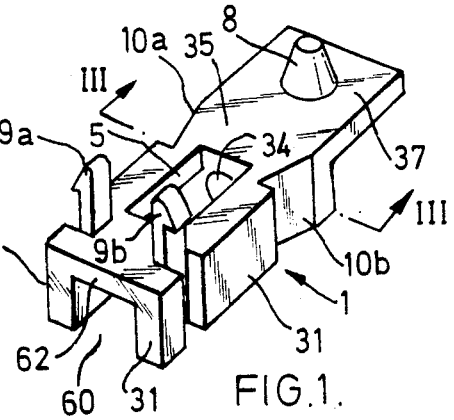
FIG. 1 is a perspective top view of a female contact housing.
Figure 1A:
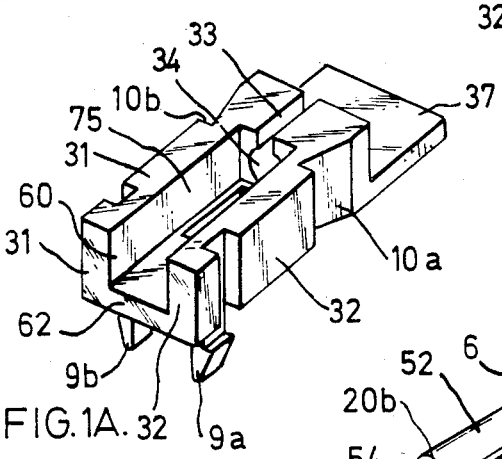
FIG. 1A is a perspective bottom view of a female contact housing.
Figure 2:
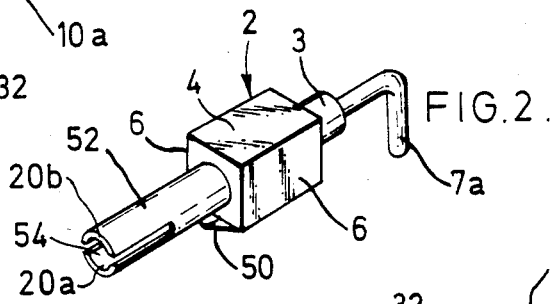
FIG. 2 is a perspective top view of the female contact.

Referring first to FIGS. 1, 1A and 2, the female part of the connector comprises a housing 1 (FIG. 1 and 1A) and a female contact member 2 (FIG. 2).

The housing 1 is molded from plastic material and has side walls 31 and 32 along the length thereof and a top 62, thereby forming a channel 75 in housing 1. It will be appreciated that molding is extremely simple with such an arrangement. The female contact member 2 is fitted to the housing by inserting it between the walls 31 and 32.

Figure 3:
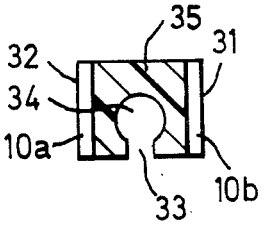
FIG. 3 is a cross section of the housing of FIG. 1 on the line III—III.

To retain the contact member 2 in channel 75 in the housing 1 a narrowed section 33 towards the rear of the housing 1 is in the form of a keyhole 34 (as shown in FIG. 3). The plastic walls 31 and 32 of the keyhole 34 flex to permit passage of the contact member 2 and return to grip the contact member 2 snugly around a circular collar 3. Tab 50 on square collar 4 on the contact member 2 partially enters a aperture 5 in the base of channel 75 in the housing 1 preventing forward or backward movement of the contact member 2 while flat side walls 6 of the collar 4 cooperate with the side walls 31 and 32 to prevent rotation of the female contact member 2.

As will be seen from FIG. 2, a solder tag 7*a* on contact member 2 is provided to allow connection of a wire. It is noted, however, that wire-wrapping or crimping may be used with suitable modification of the contact member 2. Alternatively, the contact member 2 may be provided with an insulation displacement type connection function.

Contact member 2 has a male contact member receiving portion 52. Receiving portion 52 is bifurcated at its open end 54 at lips 20*a* and 20*b*. Upon engagement of the male and female parts of the connector, lips 20*a* and 20*b* contact and engage leading end 44 of male contact member 42, as will be discussed hereinafter Returning to FIG. 1, a boss 8 is provided which is arranged for fitting in a circular aperture of a panel (not shown) to locate the housing 1 and prevent forward or backward movement relative to the panel. Additionally, two clips 9*a* and 9*b* are provided, the clips pass through a corresponding aperture in the panel to attach the connector to such a panel.

Adjacent one end 35 of the housing 1 a pair of indentations 10*a* and 10*b* are provided in wall 32 and 31, respectively, which cooperate with clips 11 (FIG. 4) when the male and female parts of the connector are mated thereby inhibiting separation of the two parts.

Figure 4:
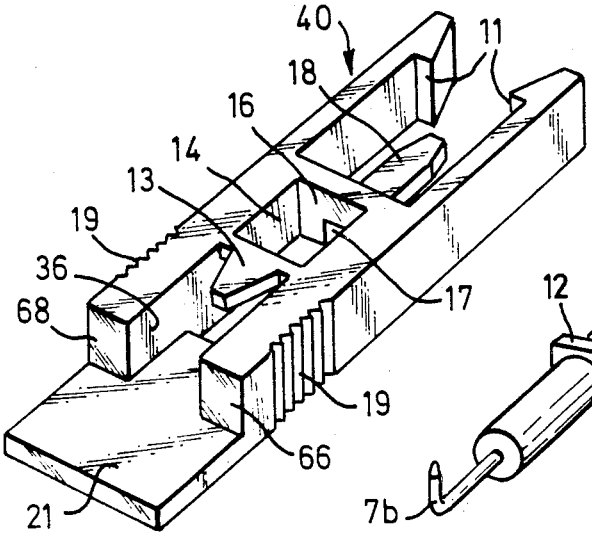
FIG. 4 is a perspective top view of a male contact housing.
Figure 5:
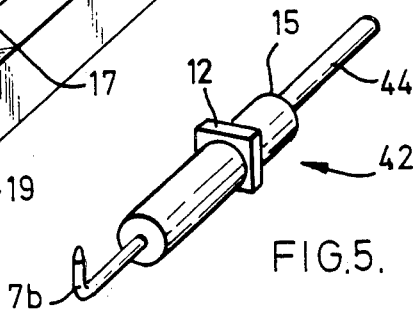
FIG. 5 is a perspective top view of the male contact.

Referring now to FIGS. 4 and 5, the male connector part comprises a plastic housing 40 (FIG. 4) and a male contact member 42 (FIG. 5).

Housing 40 has side walls 66 and 68, a flexible bridge member 13, holding compartment 14, and apertured cross member 16.

The male contact member 42 is fitted in the housing 40 by sliding the contact member 42 to insert it from the rear 36 of the housing 40. A collar 12 on member 42 displaces a flexible bridge 13 of the housing 40 to enter compartment 14 formed between the bridge 13 and apertured cross member 16. Therefore the male contact member 42 is retained in the housing 40. A shoulder 15, at a forward end of the collar 12, cooperates with the cross member 16 to restrain the male contact member 42 against forward movement. The leading end 44 of the male contact member 42 passes through aperture 17 in the cross member 16 to protrude above a supporting finger 18 of housing 40.

To facilitate manual manipulation for mating or demating of the connector assembly, finger grips 19 are provided on the external surface of the side walls 66 and 68 of the housing 40 as shown in FIG. 4.

It will be noted that the male contact member 42 is provided with a similar solder tag 7*b* to that provided on the female contact member 2. Again, any other suitable connection method may be provided for.

When male contact member 2 is fitted into male housing 1 and female contact member 42 is fitted into female housing 40, the male and female parts of the connector may be brought into engagement. Leading end 44 slides through open end 54 into receiving portion 52. Finger 18 of male housing 40 enters opening 60 of female housing 1. Thus finger 18 has two purposes. Firstly, it provides a protective closure section of channel 75 surrounding the contacts (formed by side walls 31 and 32, top 62, and finger 18) and secondly, it prevents overstressing of the bifurcated receiving part 50 of the female contact member 2 by supporting lip 20*a*.

When mating of the connector is complete, the clips 11 enter the indentations 10*a* and 10*b* thus inhibiting accidental separation of the two parts. Again, the resilience of the plastics material is used to allow passage of the clips and their return to a home position. Tapering the leading edges of the clip members 11 facilitates their forward passage.

In regard to the housings 1 and 40 (FIGS. 1 and 4), it will be noted that extended insulation sections 37 and 21, respectively, are provided to cover one side of the connection tags 7*a* and 7*b*, respectively, to assist in the prevention of short circuits.

Figure 6:
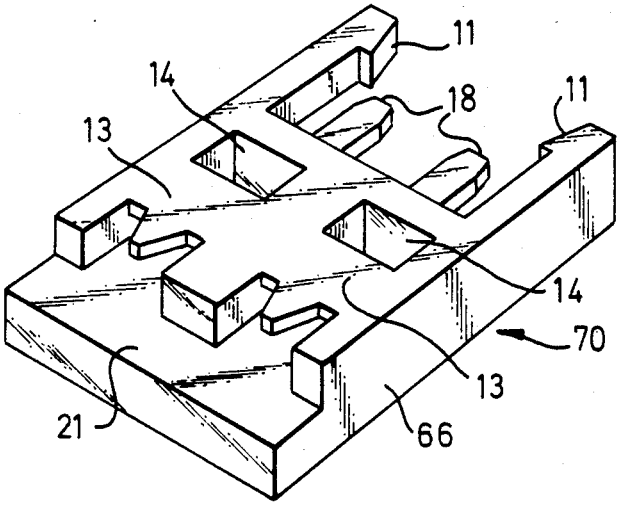
FIG. 6 is a perspective view of a modified male contact housing to provide a row of connectors.

Referring now to FIG. 6, an alternative contact housing 70 is provided in which a plurality of male contacts may be mounted side by side. It is not considered necessary to offer further explanation of the housing of FIG. 6 since its function and manufacture will be apparent to one skilled in the art by reference to the description of male housing 40 of FIG. 4.

Figure 7:
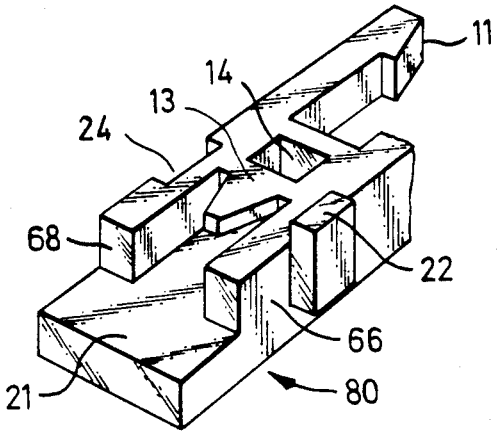
FIG. 7 shows a modification of the housing of FIG. 4 to permit stacking of the connectors.

In FIG. 7 a male contact housing 80 adapted for providing a connector stack is shown. In such an embodiment, the housing 80 is provided with a locating spigot 22 and spigot receiving notch 24. Spigot 22 is engagable with a spigot receiving notch on a connector stacked upon housing 80.

The connectors hereinbefore described are particularly suited to the interconnection of ribbon cables, the housings being easily formed from nylon o polyester materials and the contact members being formed for example of copper alloy with the contact areas plated with a suitable precious metal such as gold.

While the invention has bee described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

I claim:

1. An electrical connector comprising:

a male part further comprising an elongate male contact member having intermediate its length a collar, an open plastics housing having:

side walls;

a central cross member having an aperture therein;

a flexible bridge extending between said walls separated from said cross member by the length of said collar such that a leading end of said contact member passes through said aperture, and said collar is held between said bridge and said cross member; and clips respectively formed integrally with said walls at a forward extremity thereof; and a female part further comprising an elongate female contact member having intermediate its length a square collar with a locating tab and a circular collar adjacent thereto, an open plastics housing having:

side walls providing a central channel narrowed at a first end;

an aperture formed in a base of said channel; and external indentations adjacent said narrowed part of said channel for receiving said clips of said male part, said female contact member fitting into said channel with said square collar located by said aperture in said base of said channel and held in position by said circular collar fitting snugly into said narrowed part of said channel.

2. An electrical connector according to claim 1 including an integrally formed support finger extending forward of said cross member.

* * * * *